US007497356B2

(12) United States Patent
Beranger et al.

(10) Patent No.: US 7,497,356 B2
(45) Date of Patent: Mar. 3, 2009

(54) FLUID DISPENSER DEVICE

(75) Inventors: Stéphane Beranger, Le Neubourg (FR); Firmin Garcia, Evreux (FR)

(73) Assignee: Valois S.A.S, Le Neubourg (FR)

( * ) Notice: Subject to any disclaimer, the term of this patent is extended or adjusted under 35 U.S.C. 154(b) by 399 days.

(21) Appl. No.: 10/540,398

(22) PCT Filed: Dec. 19, 2003

(86) PCT No.: PCT/FR03/03837

§ 371 (c)(1),
(2), (4) Date: Jun. 23, 2005

(87) PCT Pub. No.: WO2004/058414

PCT Pub. Date: Jul. 15, 2004

(65) Prior Publication Data

US 2006/0169724 A1 Aug. 3, 2006

(30) Foreign Application Priority Data

Dec. 23, 2002 (FR) ..... 02 16547

(51) Int. Cl.
*B65D 88/54* (2006.01)
*B67D 5/40* (2006.01)

(52) U.S. Cl. ..... 222/321.2; 222/321.7; 222/321.9; 222/340

(58) Field of Classification Search ..... 222/321.1, 222/321.2, 321.7, 321.8, 321.9, 341, 340, 222/385

See application file for complete search history.

(56) References Cited

U.S. PATENT DOCUMENTS

| | | | | |
|---|---|---|---|---|
| 3,940,070 | A | 2/1976 | Boris | |
| 5,482,188 | A * | 1/1996 | Lina | 222/321.2 |
| 5,803,318 | A * | 9/1998 | Lina | 222/321.2 |
| 5,950,879 | A * | 9/1999 | Ritsche | 222/321.2 |
| 6,036,059 | A | 3/2000 | Vanbrocklin | |
| 6,196,424 | B1 * | 3/2001 | Bougamont et al. | 222/321.9 |
| 6,286,726 | B1 * | 9/2001 | Marelli | 222/321.7 |
| 6,471,097 | B2 * | 10/2002 | Hermouet et al. | 222/321.2 |
| 6,708,852 | B2 * | 3/2004 | Blake | 222/321.5 |
| 6,824,020 | B1 * | 11/2004 | Petit | 222/321.6 |

(Continued)

FOREIGN PATENT DOCUMENTS

AT 345 686 B 9/1978

(Continued)

OTHER PUBLICATIONS

Patent Abstracts of Japan, vol. 013, No. 265 (M-389), Jun. 19, 1989.

*Primary Examiner*—Kevin P Shaver
*Assistant Examiner*—Stephanie E Tyler
(74) *Attorney, Agent, or Firm*—Sughrue Mion, PLLC

(57) ABSTRACT

A fluid dispenser device includes a chamber provided with an inlet valve and with an outlet valve, and defining a sealed slide cylinder; a piston disposed inside the chamber and including a lip capable of sliding in sealed manner in the slide cylinder. A bearing flange for coming to bear against a reservoir neck; and a ferrule against which the piston is resiliently urged in the rest position. The device being characterized in that the sealed slide cylinder is situated above the bearing flange so that it cannot be inserted into the reservoir neck.

13 Claims, 2 Drawing Sheets

U.S. PATENT DOCUMENTS

Figure 1:
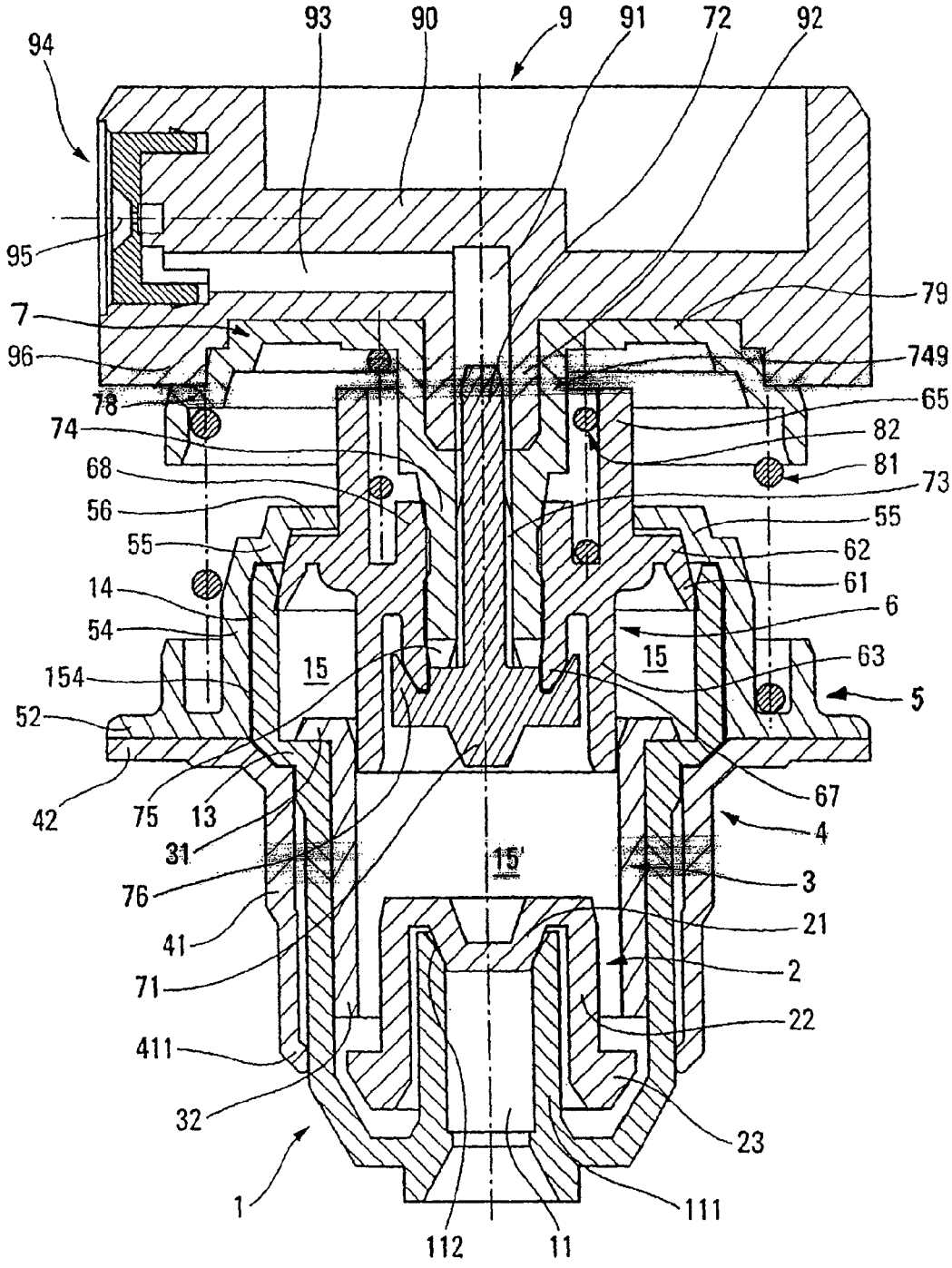

2001/0025863 A1 10/2001 Matthias et al.

FOREIGN PATENT DOCUMENTS

| | | | | | |
|---|---|---|---|---|---|
| EP | 0 795 354 | A | 9/1997 | | |
| FR | 0342651 | * | 5/1989 | ..... | 222/321.2 |
| JP | 01 066475 | A | 3/1989 | | |
| WO | 97/05043 | A | 2/1997 | | |
| WO | WO 97/05043 | A | 2/1997 | | |

* cited by examiner

FLUID DISPENSER DEVICE

The present invention relates to a fluid dispenser device, such as a pump, for being mounted on a neck of a reservoir containing fluid. The function of such a dispenser device is to take fluid from inside the reservoir and to dispense it, advantageously in measured doses, from the dispenser head, which can be in the form of a pushbutton fitted with a nozzle. Such dispenser devices or pumps are often used in the fields of perfumery, cosmetics, or even pharmacy.

A conventional pump of the prior art may comprise a chamber provided with an inlet valve and with an outlet valve, and defining a sealed slide cylinder inside which the piston defining a lip can slide in sealed manner. The pump may also comprise an actuator rod on which the piston is slidably mounted. Furthermore, the pump may comprise a bearing flange for coming to bear on the neck of the reservoir. The flange may even serve to fasten the pump on the reservoir neck. In addition, the pump may also comprise a ferrule against which the piston is resiliently urged in the rest position. Naturally, the rest position corresponds to the position in which the outlet valve is hermetically sealed. In general, the piston is mounted on an actuator rod defining a central channel through which the fluid put under pressure in the chamber flows while the outlet valve is open.

In conventional manner, the pump is mounted inside the reservoir neck, with the slide cylinder of the piston being contained completely inside the neck. In general, the necks of perfume bottles, or bottles for pharmaceutical substances, present a diameter that is relatively small, such that the sealed slide cylinder must extend over a height that is relatively long in order to define chamber volume that is acceptable. This has the effect of elongating the pump, which thus extends with its bottom end below the neck, i.e. inside the reservoir.

An object of the present invention is to remedy the above-mentioned drawback of the prior art by defining a pump having a configuration that is less elongate, and having a chamber volume that is not linked to the inside diameter of the reservoir neck.

In order to achieve this object, the present invention provides a sealed slide cylinder that is situated above the bearing flange, so that it cannot be inserted into a reservoir neck. It is thus possible to avoid the limitation imposed by the inside diameter of the neck. Given that the inside diameter of the slide cylinder can thus be significantly greater than the inside diameter of the neck, it is possible to have a chamber of considerable volume for a cylinder of small height. As a result, the stroke of the pump, i.e. of the actuator rod and of the piston, can be very short, but without that limiting the volume of the chamber. The slide cylinder advantageously defines a bottom abutment end situated substantially at the bearing flange. This means that the entire slide cylinder is situated outside the reservoir neck.

According to another characteristic of the invention, which is not necessarily linked to the disposition of the slide cylinder outside the reservoir, the piston is provided with guide means for holding it on the axis inside the chamber. The guide means advantageously include a top guide sleeve engaged in a through hole formed by the ferrule. In addition, the guide means may include a bottom guide sleeve engaged in a bushing defining a bottom portion of the chamber. This is particularly advantageous when the actuator rod is not in contact with the ferrule. The top sleeve may advantageously surround the actuator rod. In a conventional pump, the ferrule, which closes the pump, defines the top dead point of the piston. It also defines a central hole through which the actuator rod slides. As a result, the actuator rod and the piston are held accurately on the axis as a result of the separation that exists between the piston and the actuator rod. In the configuration of the present invention in which the rod is not in contact with the ferrule, it is nevertheless necessary to hold the actuator rod and the piston on the axis, and in this embodiment, this is achieved by providing one or preferably two guide sleeves, respectively engaged in the ferrule and in a bushing disposed inside the chamber. Naturally, this characteristic, linked to guiding the actuator rod and the piston, can be implemented in any pump, which need not necessarily be provided with a sealed slide cylinder situated above the bearing flange. However, guidance of the actuator rod and of the piston is preferably used with this configuration of the cylinder outside the neck, as a result of the stroke of the piston being relatively short because of the relatively large diameter of the slide cylinder. Thus, the top and bottom sleeves do not need to be extended significantly in order to provide their guide function.

The bushing advantageously defines the bottom portion of the chamber and defines a bottom end serving as an abutment for the inlet valve in the open position.

According to another aspect of the invention, a precompression spring, situated outside the chamber, bears between the rod and the piston so as to urge the outlet valve into the closed position. In addition, a return spring, situated outside the chamber, can bear between the rod and the ferrule so as to urge the piston into the rest position. Thus, the fluid inside the chamber does not come into contact with the springs which are generally made of metal.

According to another characteristic of the invention, a return spring, situated outside the chamber, bears between the rod and the ferrule so as to urge the piston into the rest position. The ferrule can thus be held, together with the bearing flange, on the reservoir neck by means of any kind of fastener ring, e.g. a screw-on, snap-fastenable, or clampable ring.

According to another aspect, the slide cylinder is formed by a body, the bearing flange being formed by a ring engaged around the body. The pump body is thus blocked between the ring forming the flange and the ferrule.

According to another characteristic of the invention, the chamber defines a top portion situated above the bearing flange, and a bottom portion situated below the flange, the slide cylinder being situated at the top portion. It is not necessary for the entire volume of the pump chamber to be situated above the flange, it suffices merely for the slide cylinder of the piston to be situated above the flange. However, it is preferable for the bottom portion of the chamber to be substantially or completely empty when the piston reaches its bottom position in the slide cylinder.

The invention is described more fully below with reference to the accompanying drawings which show an embodiment of the invention by way of non-limiting example.

Figure 2:
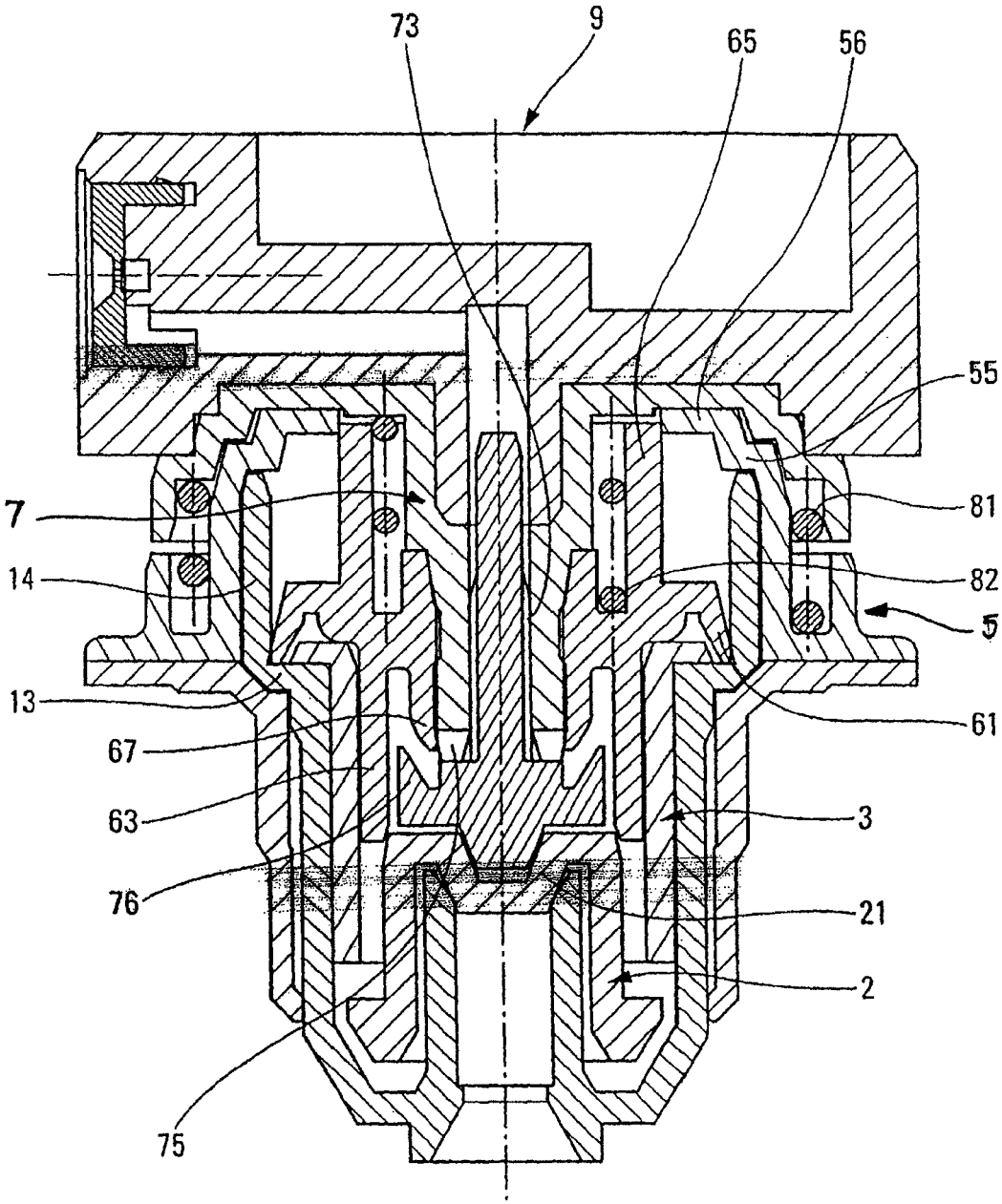

In the figures:

FIG. 1 is a vertical section through a dispenser device of the invention in the rest position; and FIG. 2 is a view similar to that of FIG. 1, but in the actuated position.

The fluid dispenser of the invention shown in FIGS. 1 and 2 is a pump. It includes a body 1 which is advantageously circularly symmetrical. The body includes a bottom portion defining an inlet 11 for the fluid. The inlet 11 is further provided with a sleeve 111 defining an inlet-valve seat 112 at its top end. The seat 112 co-operates with an inlet-valve moving member 2 which is in the form of an upsidedown bucket having an end wall 21 that is shaped in such a manner as to co-operate with the valve seat 112 so as to provide a sealed contact. The moving member 2 also includes an outer skirt 22 which surrounds the sleeve 111 in concentric manner. At its bottom end, the skirt 22 forms an abutment collar 23 which extends radially outwards. It should also be observed that the shape of the abutment collar 23 corresponds substantially to the shape of the bottom portion of the body 1 so that a large volume does not remain between the collar 23 and the body 1. Above the inlet 11, the body forms a first drum 12 which, in this embodiment, is cylindrical, but which could be in some other form, e.g. stepped. The drum 12 is terminated at its top end by a shoulder 13 which projects outwards. A bushing 3 is disposed inside the drum 12 and extends over a large fraction of its height.

The bushing 3 includes a top rim 31 that projects outwards and that comes to rest on the shoulder 13 formed by the body. In addition, the bushing 3 defines a bottom end 32 that serves as an abutment surface against which the abutment collar 23 of the moving member 2 of the inlet valve can selectively come into abutment, while the valve is open. The abutment end 32 thus defines the stroke of the moving member 2 inside the body 1. In other words, the moving member 2 is held captive inside the body 1 as a result of the bushing 3 preventing it from being extracted. During assembly, the moving member 2 is inserted into the body first, then the bushing 3 is inserted inside the drum 12. Beyond the outer shoulder 13, the body 1 defines a second drum 14 which defines a sealed slide cylinder, as described below.

A ring 4 is mounted around the body 1 level with the first drum 12. The ring 4 includes a substantially cylindrical portion 41 defining a bottom end 411 which comes into contact with the drum 12. At its top end, the substantially cylindrical portion 41 comes into abutment beneath the shoulder 13. The ring 4 also includes a bearing flange 42 which extends outwards from the top end of the substantially cylindrical portion 41. It should be observed that a space exists between the substantially cylindrical portion 41 and the drum 12. This space could advantageously be used to enable the substantially cylindrical portion 41 to deform without interfering with the drum 12. The bearing flange 42 defines a bottom face for coming into contact with a portion of a reservoir, preferably the top end of the neck of the reservoir. The substantially cylindrical portion 41 is thus designed to extend inside the neck of the reservoir, and can advantageously come into clamping contact with its inner wall. As a result of the space existing between the portion 41 and the drum 12, it is possible to deform the portion 41 inwards a little without coming into contact with the drum 12, or deforming it.

A ferrule 5 is engaged around the second drum 14, advantageously with a clamping contact providing a secure fastening. The ferrule 5 includes a collar 52 which extends radially outwards. The collar is disposed in contact with the bearing flange 42 formed by the ring 4. From the collar 52, the ferrule forms a tower 54 of substantially cylindrical shape. The tower 54 comes into contact with the outer wall of the drum 14, and this contact advantageously fastens the ferrule 5 onto the body 1. The tower 54 is extended at its top end by a first inwardly-directed rim 55 which comes into contact with the top end of the second drum 14. Beyond the first inwardly-directed rim 55, the ferrule forms a second inwardly-directed rim 56 of annular shape defining a central through hole. The inside diameter of the through hole is less than the inside diameter of the second drum 14. The second inwardly-directed rim 56 of the ferrule 5 thus reduces the size of the hole inside the body 1.

A vent passage 154 is advantageously formed between the body 1 and the ferrule 5, and between the body 1 and the ring 4. The passage is shown in the form of a thick line, but in practice the passage can be formed by a groove formed in the body 1. At is bottom end, the passage is selectively closed by the bottom end 411 of the ring which can be elastically deformable so as to enable air to enter, and so as to prevent fluid from escaping. At its top end, the passage is closed by a cone-shaped sealing contact between the rim 55 and a lip base 62. In the actuated position, this contact is broken, and outside air can penetrate into the passage via the second rim 56, and can leave the passage by raising the end 411 of the ring.

A piston 6 is disposed in part inside the body 1. The piston 6 defines the lip base 62 that is terminated by a sealing lip 61 for sliding in sealed manner inside the drum 14, thereby defining a sealed inner slide cylinder. The sealing lip 61 can be displaced in the sealing cylinder over a certain stroke that is downwardly limited by the outer shoulder 13, and upwardly limited by the second inwardly-directed rim 56. The shoulder 13 thus defines the bottom dead point of the piston, while the second inwardly-directed rim 56 of the ferrule 5 defines the top dead point of the piston. Given that the shoulder 13 serves as an abutment to the bearing flange 42 which is designed to come into contact with the top end of a reservoir neck, the second drum 14, and consequently the sealed inner slide cylinder, is situated above the flange 42, and consequently above the neck or the opening of the reservoir, once the pump is mounted on the reservoir. This is a first advantageous characteristic of the invention. As a result of the sealed slide cylinder of the piston being situated outside the reservoir neck, its diameter does not depend on the inside diameter of the neck. A pump can thus be made in which at least a portion of the pump chamber is situated outside the neck. This is precisely the case in the pump of the present invention which defines a top chamber 15 level with the second drum 14, and a bottom chamber 15' level with the first drum 12. The top chamber 15 and the bottom chamber 15' together form the pump chamber. The inside diameter of the bottom chamber 15' is naturally dependent on the inside diameter of the neck or of the opening of the reservoir, given that the pump is inserted in and remains engaged in the opening or the neck once it has been mounted on the reservoir. In contrast, the top chamber 15 is in no way limited or even influenced by the diameter of the opening or of the neck of the reservoir. It is thus possible to increase the volume of the pump chamber considerably by increasing the diameter of the second drum 14. It is also possible to make a pump having a very short stroke. It should also be observed that the slide cylinder defined by the second drum 14 is situated entirely above the flange 42, so that the entire slide cylinder is situated outside the neck or the opening of the reservoir.

According to another characteristic of the invention, which can be implemented independently of the characteristic linked to the fact that the slide cylinder of the piston is situated outside the reservoir neck, i.e. above the bearing flange 42, the piston 6 is provided with guide means that enable the piston 6 to be held on the axis of symmetry of the body 1. In other words, the guide means enable the piston 6 to be displaced in completely axial manner inside or relative to the body 1. In this embodiment, the guide means are in the form of two sleeves, namely a bottom sleeve 63 and a top sleeve 65. The bottom sleeve 63 is designed and disposed in such a manner as to be able to slide without sealing inside the bushing 3 engaged inside the first drum 12 of the body 1. It is important that there is no sealed contact between the bottom sleeve 63 and the bushing 3, so that the top chamber 15 can communicate with the bottom chamber 15'. To achieve this, it is possible to make the bottom sleeve 63 with an outside diameter that is less than the inside diameter of the bushing 3. It is also possible to envisage providing the outer wall of the bottom sleeve 63 with longitudinal grooves that enable the chambers 15 and 15' to communicate with each other. The top sleeve 65 is designed and disposed so that it slides inside the through hole defined by the second inwardly-directed rim 56 of the ferrule 5. The top sleeve 65 can even slide in sealed manner inside the ferrule. The sleeves 63 and 65 naturally present a height that is sufficient to enable sliding to take place over the entire height of the stroke of the piston 61 inside the second drum 14. With reference to FIG. 1, it can be seen that the piston lip 61, in the rest position, i.e. in abutment against the second inwardly-directed rim 56, is relatively far from the bushing 3 inside which the bottom portion of the sleeve 63 is engaged. This ensures that the piston 6 is held securely on the axis inside the body 1. In addition, and with reference to FIG. 2, it can be seen that the lip 61 of the piston 6, while it is in abutment against the shoulder 13, is relatively far from the second inwardly-directed rim 56 inside which the top sleeve 65 is engaged. Once again, this ensures that the piston 6 is held securely on the axis inside the body 1. However, it is possible to omit the top sleeve 65, given that the bottom sleeve 63 is then completely engaged inside the bushing 3, thereby defining unsealed cylindrical contact over a considerable height. The bottom sleeve 63 alone can thus ensure the function of guiding the piston 6 on the axis inside the body 1.

The piston 6 also defines an inner cuff 68 which defines a bottom end 67 serving as an outlet-valve moving member.

The cuff 68 is engaged on an actuator rod 7 on which it can slide in limited manner. In the rest position, the bottom end 67 of the cuff is in sealed bearing contact against an outlet-valve seat 76 formed by a head 71 of the actuator rod 7. The head 71 preferably presents a bottom profile corresponding to the profile of the end wall 21 of the bucket formed by the outlet-valve moving member 2, so as to reduce the dead volume of the bottom chamber 15' while the pump is in the actuated position, as shown in FIG. 2. The head 71 is also formed with a central pin 72. For practical manufacturing and assembly reasons, in this embodiment, the actuator rod 7 is made out of two parts, namely the head 71 and an annulus 74. The annulus 74 defines a central passage 73 inside which the pin 72 of the head 71 is engaged. However, the pin 72 does not fill the entire passage 73, such that one or a plurality of peripheral channels exist, situated around the pin 72. The annulus 74 also includes a crenellated bottom end, for co-operating with the head 71 to define lateral slots 75 which are closed on their outside by the bottom lip 67 formed by the cuff 68, as shown in FIG. 1. This corresponds to the rest position of the pump. In contrast, in the actuated position, as shown in FIG. 2, the slots 75 are open so that the channel(s) 73 can communicate with the inside of the chamber via the open slots 75. The fluid contained inside the chamber 15, 15' and put under pressure by the piston 6, can thus escape through the actuator rod 7 while the cuff 68 is moved along the rod under the effect of the pressure existing inside the chamber. This is a conventional design for an actuator rod fitted with a free piston, and together forming the outlet valve. Such an arrangement is described in document FR 2 765 638, for example. The annulus 74 also forms a cover 79 which is provided on its outside with a downwardly-directed rim 78.

The rim 78 serves as a bearing for a return spring 81 which also comes into engagement with the collar 52 of the ferrule 5. The return spring 81 enables the actuator rod 7 to be returned to a rest position, as shown in FIG. 1. The spring 81 can also serve to return the cuff 68 into the closed position of the outlet valve, as shown in FIG. 1. However, it is also possible to provide the pump with a precompression spring 82 which acts between the cover 79 and the piston 6. By way of example, the precompression spring 82 can be housed inside the top sleeve 65 that is around the cuff 68. The spring 82 enables the cuff 68 to be returned into the closed position of the outlet valve as soon as the pressure inside the chamber drops below the force exerted by the spring 82. It should be observed that the spring(s) are situated outside the pump chamber. There is thus no contact between the fluid and the springs which are usually made of steel.

The top end of the annulus 74 forms a housing 749 for co-operating with a pushbutton 9 advantageously including a fastener sleeve 92 that is force-fitted in the housing 749. The pushbutton can rest on the cover 79 and on the rim 78 with a crown 96. The pushbutton defines a connection duct 91 that is in communication with the channels 73 and with an outlet channel 93 which leads to a nozzle 94 defining a dispenser orifice 95.

It should also be observed that in the pump of the invention, the actuator rod 7 is guided neither by the body 1 nor by the ferrule 5. The only part with which it is in contact is the piston 6 which slides inside the drum 14. As a result, it is particularly advantageous, but not indispensable, to combine the slide cylinder situated outside the neck with the guide means for the piston. However, it is also possible to fit a piston with guide means without the slide cylinder being situated outside the neck. It should be observed that the top sleeve extends concentrically around the actuator rod.

By means of the invention, a pump is provided of height that can be reduced so that the bottom end of the body 1 extends inside the neck only, without projecting inside the reservoir. This can be particularly advantageous for reasons of appearance. In addition, the height of the pump above the neck can also be reduced, given that it suffices to increase the diameter of the drum 14 in order both to increase the volume of the chamber, and to reduce the stroke of the piston.

The invention claimed is:

1. A fluid dispenser device, comprising:

a chamber (15, 15') provided with an inlet valve (2, 112) and with an outlet valve (67, 76), and defining a sealed slide cylinder (14);

a piston (6) disposed inside the chamber and including a lip (61) capable of sliding in sealed manner in said slide cylinder (14);

an actuator rod (7) on which the piston (6) is slidably mounted;

a bearing flange (42) for coming to bear against a reservoir neck; and a ferrule (5) against which the piston (6) is resiliently urged in the rest position;

said device being characterized in that said chamber comprises a top portion (15) and a bottom portion (15'), the sealed slide cylinder (14) being situated above the bearing flange (42), at the top portion, so that it cannot be inserted into a reservoir neck, and in that the bottom portion (15') is situated below the flange (42), so as to be inserted into the reservoir neck.

2. A fluid dispenser device according to claim 1, in which the slide cylinder (14) defines a bottom abutment end (13) situated substantially at the bearing flange.

3. A fluid dispenser device according to claim 1, in which the piston (6) is provided with guide means (63, 65) for holding it on the axis inside the chamber.

4. A fluid dispenser device according to claim 3, in which the guide means include a top guide sleeve (65) engaged in a through hole formed by the ferrule (5).

5. A fluid dispenser device according to claim 1, in which said rod is not in contact with the ferrule.

6. A fluid dispenser device according to claim 4, in which the top sleeve (65) surrounds the actuator rod (7).

7. A fluid dispenser device according to claim 3, in which the guide means include a bottom guide sleeve (63) engaged in a bushing (3) defining a bottom portion (15') of the chamber.

8. A fluid dispenser device according to claim 7, in which the bushing (3) defines a bottom end (32) serving as an abutment for the inlet valve (2) in the open position.

9. A fluid dispenser device according to claim 5, in which a precompression spring (82), situated outside the chamber, bears between the rod (7) and the piston (6) so as to urge the outlet valve (67, 76) into the closed position.

10. A fluid dispenser device according to claim 5, in which a return spring (81), situated outside the chamber, bears between the rod (7) and the ferrule (5) so as to urge the piston (6) into the rest position.

11. A fluid dispenser device according to claim 1, in which the slide cylinder (14) is formed by a body, the bearing flange (42) being formed by a ring (4) engaged around the body (1).

12. A fluid dispenser device according to claim 1, including a pushbutton (9) forming a fastener sleeve (92), the actuator rod (7) defining a housing (749), the sleeve being engaged in the housing.

13. A fluid dispenser device according to claim 1, including a vent passage (154) that is closed in the rest position by a cone-shaped sealing contact.

* * * * *